US008979407B2

(12) United States Patent
Butzen et al.

(10) Patent No.: US 8,979,407 B2
(45) Date of Patent: Mar. 17, 2015

(54) PLATEN ASSEMBLY

(75) Inventors: James K. Butzen, Libertyville, IL (US); Jake Myre, Beaver Dam, WI (US); Mark Urban, Mundelein, IL (US)

(73) Assignee: ZIH Corp., Lincolnshire, IL (US)

( * ) Notice: Subject to any disclaimer, the term of this patent is extended or adjusted under 35 U.S.C. 154(b) by 1333 days.

(21) Appl. No.: 11/835,898

(22) Filed: Aug. 8, 2007

(65) Prior Publication Data

US 2009/0038495 A1 Feb. 12, 2009

(51) Int. Cl.
*B41J 11/04* (2006.01)

(52) U.S. Cl.
CPC ..... *B41J 11/04* (2013.01)
USPC ..... 400/660; 400/692; 400/648

(58) Field of Classification Search
CPC ..... B41J 11/16; B41J 11/04; B41J 11/02; B41J 11/14
USPC ..... 400/545, 660, 692, 649, 648
IPC ..... B41J 11/04
See application file for complete search history.

(56) References Cited

U.S. PATENT DOCUMENTS

| | | | | |
|---|---|---|---|---|
| 5,044,800 | A * | 9/1991 | Rosenthal | 400/660 |
| 2006/0210341 | A1* | 9/2006 | Naito | 400/545 |

FOREIGN PATENT DOCUMENTS

| | | | |
|---|---|---|---|
| EP | 0367 560 | | 5/1990 |
| GB | 17585 | | 9/1916 |
| JP | 11005336 | A * | 1/1999 |
| JP | 2003127445 | A * | 5/2003 |
| JP | 2006272845 | | 10/2006 |

OTHER PUBLICATIONS

European Search Report; EP Application No. 08 25 2520; Nov. 27, 2008; 5 pages.

* cited by examiner

*Primary Examiner* — Judy Nguyen
*Assistant Examiner* — Jennifer Simmons
(74) *Attorney, Agent, or Firm* — Alston & Bird LLP

(57) ABSTRACT

A platen assembly for a printer comprised of a platen roller assembly and a housing assembly that is structured to rotatably support the platen roller assembly. More particularly, the present invention is directed to a platen roller assembly comprising a platen roller defining first and second ends; a locking pin extending from at least one of the first and second ends of the platen roller; a housing assembly adapted to rotatably support the platen roller; and a drive assembly structured to rotatably engage the locking pin extending from one end of the platen roller. In this regard, the present invention provides a platen roller assembly that is simple, easily alignable, and readily replaceable by a user.

21 Claims, 11 Drawing Sheets

PLATEN ASSEMBLY

BACKGROUND OF THE INVENTION

1) Field of the Invention

Various embodiments of the present invention relate generally to an improved platen assembly for a printer and, more specifically, to a platen assembly that is structured for quick and efficient installation, removal, and/or replacement.

2) Description of Related Art

Platen rollers are widely used in printers to drive media against a printhead during printing operations. The platen roller provides a soft, often rubberized, surface for gripping and manipulating the media against the printhead. For print quality purposes, it is often important for the platen roller to apply a relatively constant and uniform pressure against the printhead along the full length of the platen roller.

Over the lifetime of a printer, platen rollers may need to be replaced due to abuse or normal wear and tear. If not replaced, a worn out or otherwise defective platen roller may provide uneven pressure against the printhead causing poor print quality or other problems. Accordingly, a need exists to ensure that worn or defective platen rollers, and any associated components, may be quickly and efficiently replaced.

For repeatable high quality printing, the printhead is closely aligned with respect to the printer platen. However, each time the platen is exchanged, the alignment between the printhead and platen is disturbed. Thus, a need exists to ensure that a replaced platen may be readily oriented in a fixed and aligned position relative to the printhead.

FIG. 1 depicts a printer structured in accordance with the known prior art. The printer 10 includes a printer housing 14 having a media door 12 that may be opened by a user to expose various internal printer components. In the depicted printer 10, such internal printer components may include a media hanger assembly 13, a platen assembly 20, and a printhead assembly 40. The media hanger assembly 13 may be a hanger as shown for supporting a spooled media such as adhesively backed labels. As is readily apparent to one of ordinary skill in the art, the media is drawn from a media supply spool (not shown) supported by the hanger assembly 13 and fed between the printhead assembly 40 and the platen assembly 20 during printing operations. The printhead assembly 40 may include a thermal demand printhead, an ink jet printhead, or other conventional printhead technologies.

FIG. 2 is a detail view of the prior art platen assembly 20 shown in FIG. 1. The depicted platen assembly 20 includes a platen housing 36 that defines first and second support members 38, 39 that are adapted to support a platen roller assembly 60. The depicted platen roller assembly 60 includes a platen roller 21 and first and second clips 23, 24 for securing the platen roller 21 to the first and second support members 38, 39 at respective ends of the platen roller 21. A drive shaft 22 is provided for connecting to a stepper motor (not shown) that is adapted to drive the platen roller 21 during printing operations.

FIG. 3 is an exploded view of a platen assembly 20 structured in accordance with the known prior art. As noted above, the platen assembly 20 includes a platen roller assembly 60 that is secured to a platen housing 36 by the first and second clips 23, 24. The depicted platen roller assembly 60 includes a platen roller 21, a drive shaft 22, first and second support bearings 33, 34 disposed at opposite ends of the platen roller 21, and a wave spring or washer 35 used in mounting the second support bearing 34 as shown. When the platen roller assembly 60 is installed in the housing 36, the first and second support bearings 33, 34 are positioned within first and second support notches 31, 32 defined in the first and second support members 38, 39 of the housing 36.

In many prior art applications, replacement of the platen roller 21 requires the application of several relatively complex steps. First, the stepping motor (not shown) must be loosened with a screwdriver or similar tool and disengaged from the platen roller assembly 60. A drive belt (not shown) must then be removed from the disengaged stepping motor. Next, as suggested in FIG. 2, two flathead screwdrivers or other similar tools 5 are used to apply pressure to dislocate the barbed first and second clips 23, 24 from the first and second support members 38, 39 of the platen housing 36. Once the clips 23, 24 are removed, the platen roller assembly 60 may be removed from the first and second support members 38, 39 of the platen housing 36.

As will be apparent to one of skill in the art, it is typically quite difficult to manipulate screwdrivers or other tools within the tight confines of the printer housing. It also may be difficult to disassemble the drive assembly (e.g., stepping motor, drive belt, etc.). Thus, it would be desirable then to provide a platen assembly that may be quickly and simply installed and replaced without requiring the use of tools.

BRIEF SUMMARY OF THE INVENTION

The present invention addresses the above needs and achieves other advantages by providing a platen assembly comprised of a platen roller assembly and a housing assembly that is structured to rotatably support the platen roller assembly. More particularly, the present invention is directed to a platen roller assembly comprising a platen roller defining first and second ends; a locking pin or other drive element extending from at least one of the first and second ends of the platen roller; a housing assembly adapted to rotatably support the platen roller; and a drive assembly structured to rotatably engage the locking pin extending from one end of the platen roller. In this regard, the present invention provides a platen roller assembly that is simple, easily alignable, and readily replaceable by a user without requiring the use of tools or disassembly of the drive assembly.

In one embodiment, the platen assembly may be comprised of: a platen roller defining first and second ends; a locking pin or other drive element extending from at least one of the first and second ends of the platen roller; a housing assembly adapted to rotatably support the platen roller; and a drive assembly structured to rotatably engage the locking pin extending from at least one of the first and second ends of the platen roller.

First and second platen bearing assemblies may be disposed proximate the first and second ends of the platen roller respectively. In such embodiments, the first and second platen bearing assemblies may be adapted to be slidably received by the platen roller housing. More particularly, the housing assembly may comprise a first support member defining a first lock pocket and a second support member defining a second lock pocket, wherein the first and second platen bearing assemblies are adapted to be slidably received by the first and second lock pockets respectively. In some embodiments, the first platen bearing assembly may define a first key portion and the second platen bearing assembly may define a second key portion, wherein the first and second key portions are structured such that the first and second bearing assemblies are prevented from rotating upon being slidably received by the first and second lock pockets.

In still other embodiments, the platen roller may comprise a platen axle and the locking pin may comprise two prongs that extend from the platen axle. The drive assembly may comprise a drive coupler defining a central cavity and two drive notches for receiving the platen axle and the two prongs of the locking pin, respectively. In other embodiments, the locking pin may include three or more prongs that would correspond to three or more drive notches defined in the drive coupler as will be apparent to one of skill in the art in view of this disclosure.

BRIEF DESCRIPTION OF DRAWINGS

The accompanying drawings, which are incorporated in and constitute a part of this specification, illustrate embodiments of the invention and, together with a general description of the invention given above, and the detailed description of the embodiments given below, serve to ex-plain the principles of the invention.

DETAILED DESCRIPTION OF THE INVENTION

The present invention now will be described more fully hereinafter with reference to the accompanying drawings, in which some, but not all embodiments of the invention are shown. Indeed, the present invention may be embodied in many different forms and should not be construed as limited to the embodiments set forth herein; rather, these embodiments are provided so that this disclosure will satisfy applicable legal requirements. Like numbers refer to like elements throughout.

Figure 1:
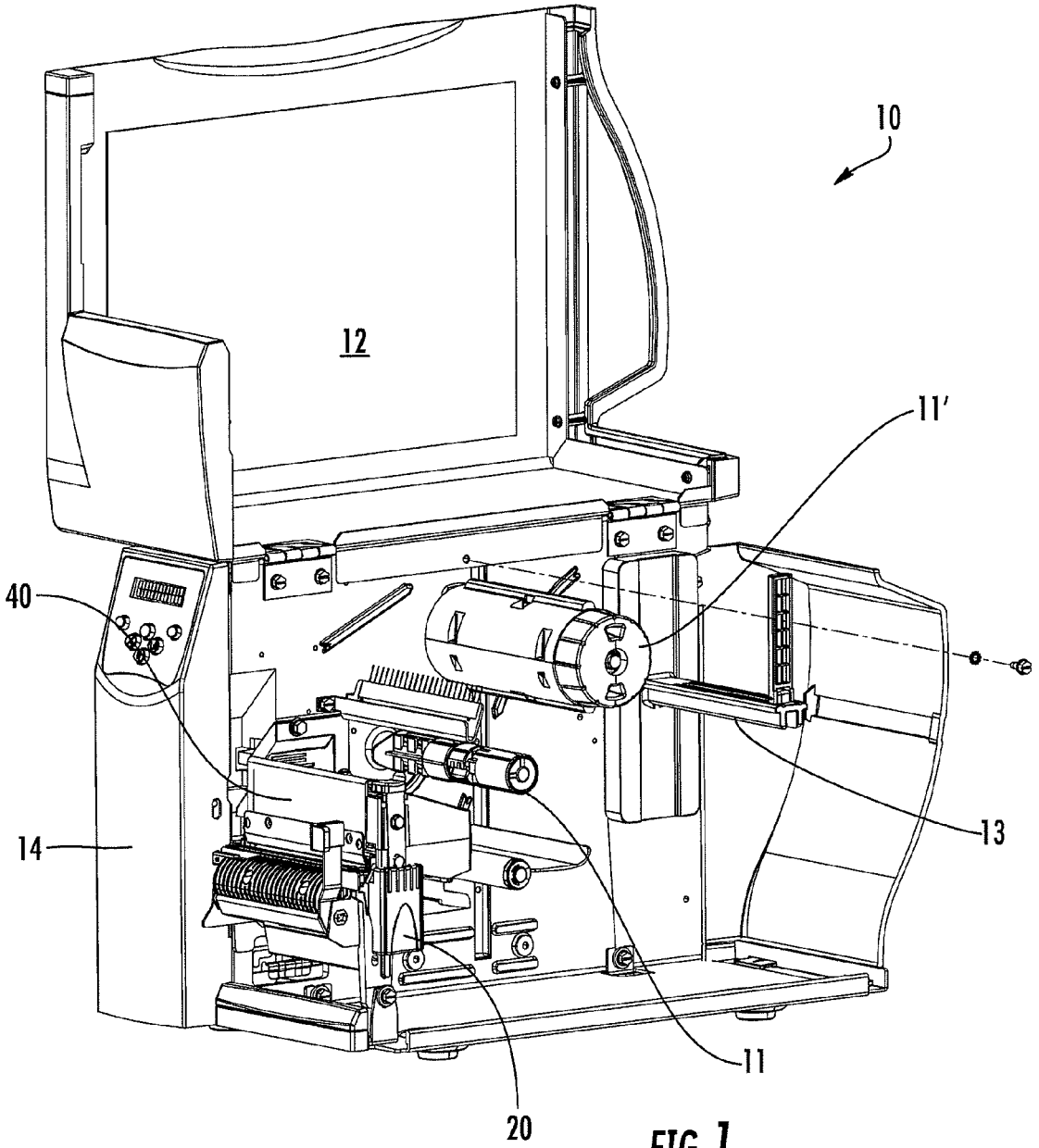
FIG. 1 (PRIOR ART)
FIG. 1 is an isometric view of a printer having a platen assembly structured in accordance with the known prior art.
Figure 2:
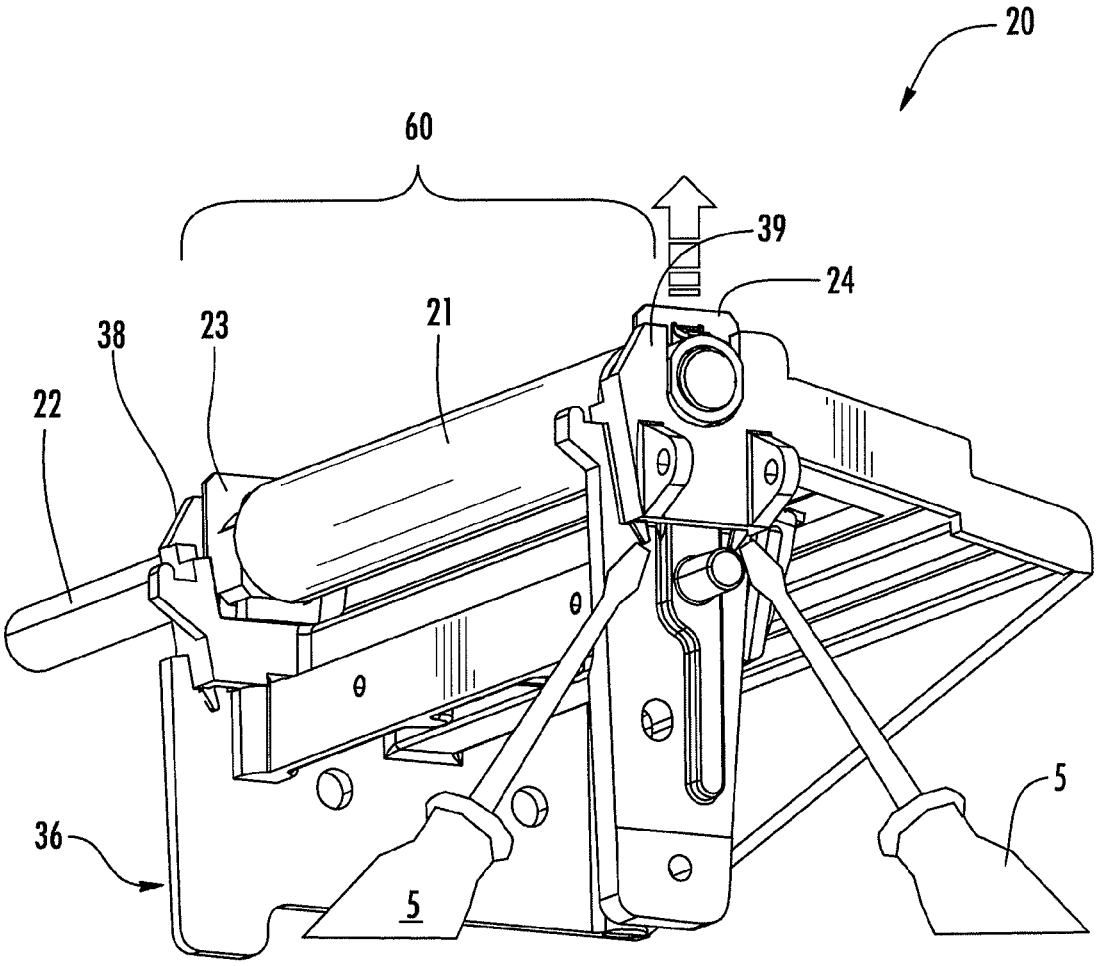
FIG. 2 (PRIOR ART)
FIG. 2 is a detail view of the prior art platen assembly shown in FIG. 1.
Figure 3:
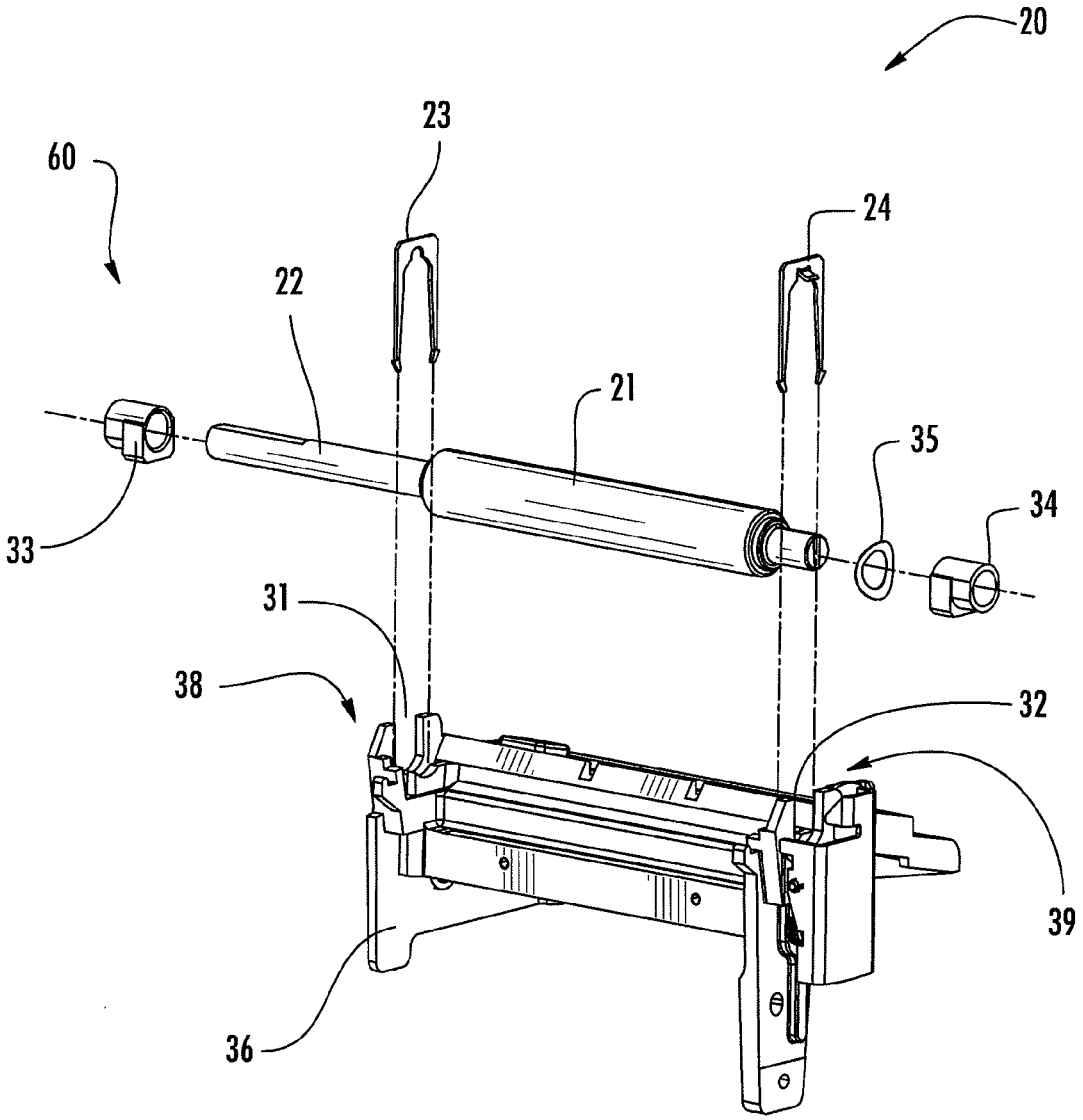
FIG. 3 (PRIOR ART)
FIG. 3 is an exploded view of the prior art platen assembly shown in FIG. 2.
Figure 4:
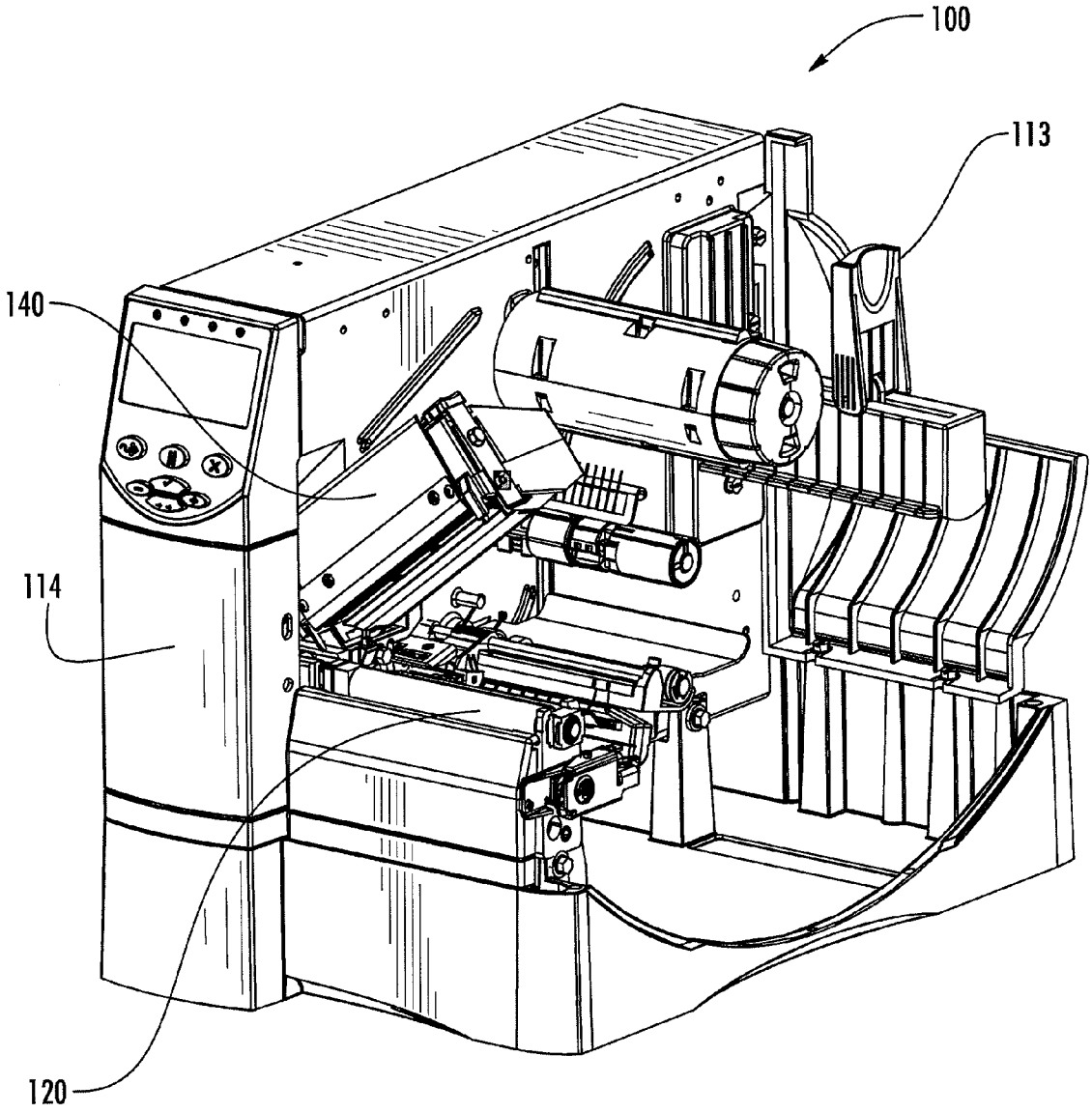
FIG. 4 is a printer having a platen assembly structured in accordance with one embodiment of the present invention.

FIG. 4 depicts a printer 100 structured in accordance with one embodiment of the present invention. The depicted printer 100 comprises a printer housing 114 enclosing various internal printer components. Such internal printer components may be comprised a media support assembly 113, a printhead assembly 140, and a platen assembly 120. The media support assembly 113 may be a hanger, as shown, for supporting a spooled media such as adhesively backed labels. As is readily apparent to one of ordinary skill in the art, the media is drawn from a media supply spool (not shown) supported by the media support assembly 113 and fed between the printhead assembly 140 and the platen assembly 120 during printing operations. The printhead assembly 140 may include a thermal demand printhead, an ink jet printhead, or any other known printhead technology. In some embodiments, the printhead assembly 140 may be rotated upwardly to expose the platen assembly 120 as shown in FIG. 4. In alternate embodiments, the printhead assembly 120 may slide laterally or may be simply removed to expose the platen assembly 120.

Figure 4A:
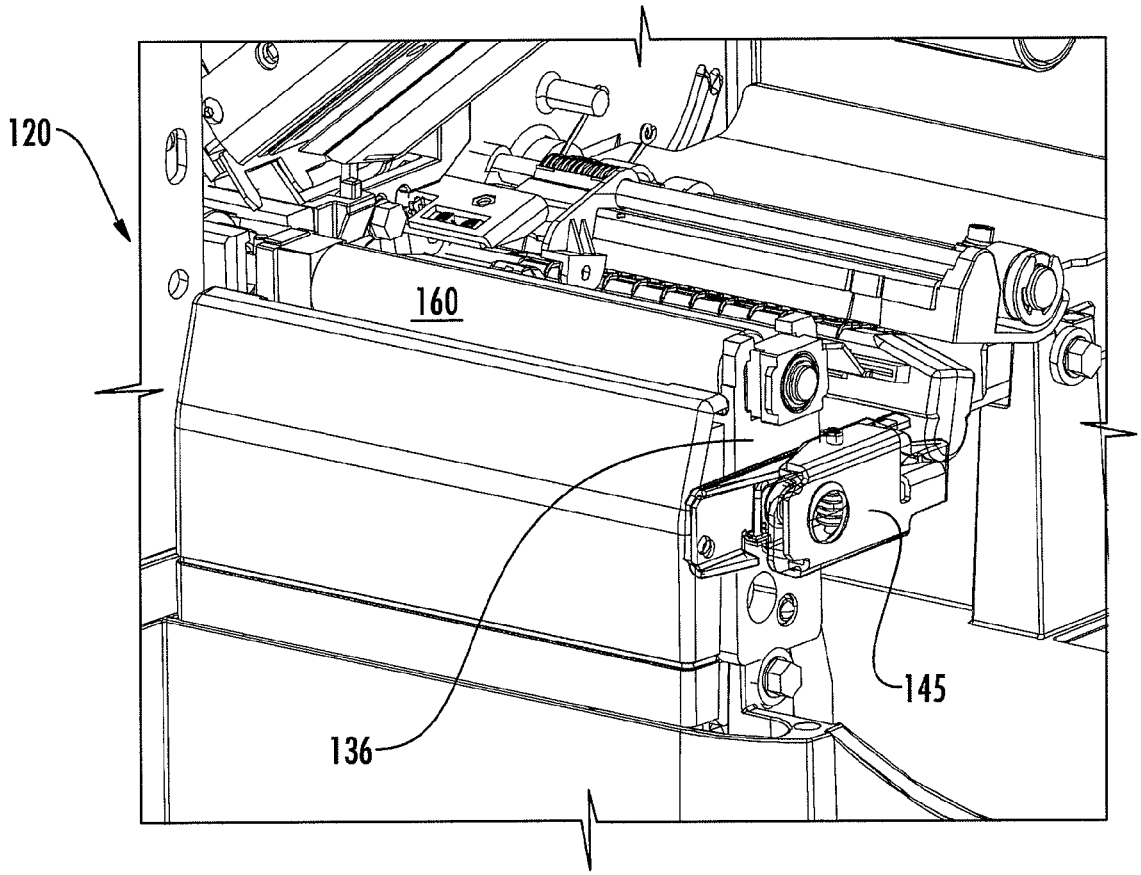
FIG. 4*a* is a detail view of the platen assembly shown in FIG. 4.

FIG. 4*a* is a detail view of the platen assembly 120 shown in FIG. 4. The depicted platen assembly 120 is comprised of a housing assembly 136, a latch assembly 145, and a platen roller assembly 160. The housing assembly 136 functions to support the platen roller assembly 160 within the printer 100 while the latch assembly 145 releasably secures the platen assembly 160 to the housing assembly 136 as discussed in greater detail below.

Figure 5:
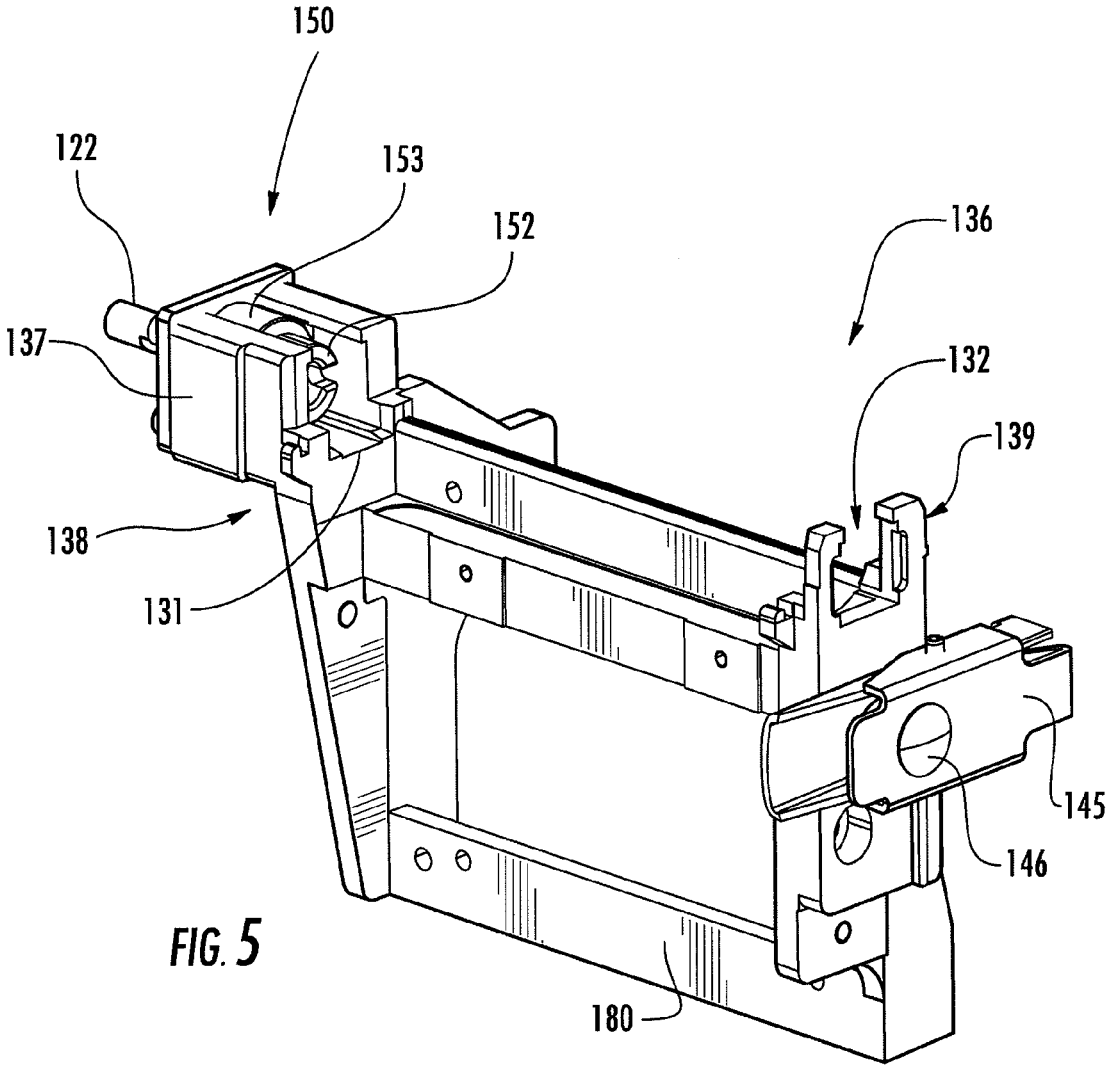
FIG. 5 is a detail view of a housing assembly for a platen assembly structured in accordance with one embodiment of the present invention.

FIG. 5 is a detail view of the housing assembly 136 shown in FIGS. 4 and 4*a*, wherein the housing assembly 136 has been removed from the printer 100. The depicted housing assembly 136 is comprised of a housing frame 180 having first and second support members 138, 139 each defining respective first and second support notches 131, 132. The housing frame 180 may be made from a rigid polymer or metal such as aluminum. A drive assembly 150 is disposed at one end of the housing frame 180 proximate the first support member 138. A latch assembly 145 is disposed at a second end of the housing frame 180 proximate the second support member 139.

The depicted drive assembly 150 (which is shown in greater detail be FIG. 7) comprises a drive housing 137 that partially encloses a drive bearing 153, a drive shaft 122, and a drive coupler 152. In the depicted embodiment, the drive housing 137 is integrally connected to or part of the housing frame 180. In alternate embodiments, the drive housing 137 may be removable from the housing frame 180 or may not be connected to the housing frame and secured to an adjacent printer component.

As will be apparent to one of skill in the art, the depicted drive bearing 153 allows the drive shaft 122 (and the drive coupler 152 connected thereto) to freely rotate relative to the drive housing 137. In one embodiment, the drive shaft 122 may be connected to a stepping motor (not shown). In other embodiments, the drive shaft 122 may be connected to a direct current motor (not shown) or other device that is adapted to rotate the drive shaft 122 during printing operations. Various gear assemblies may be added in some embodiments to change the rotational speed of the drive shaft 122 relative to the rotational speed of the drive motor or other device. In various embodiments, the drive coupler 152 is structured to be releasably coupled to the platen roller assembly 160 for driving the platen roller 121 as discussed in greater detail with regard to FIG. 7.

Figure 6:
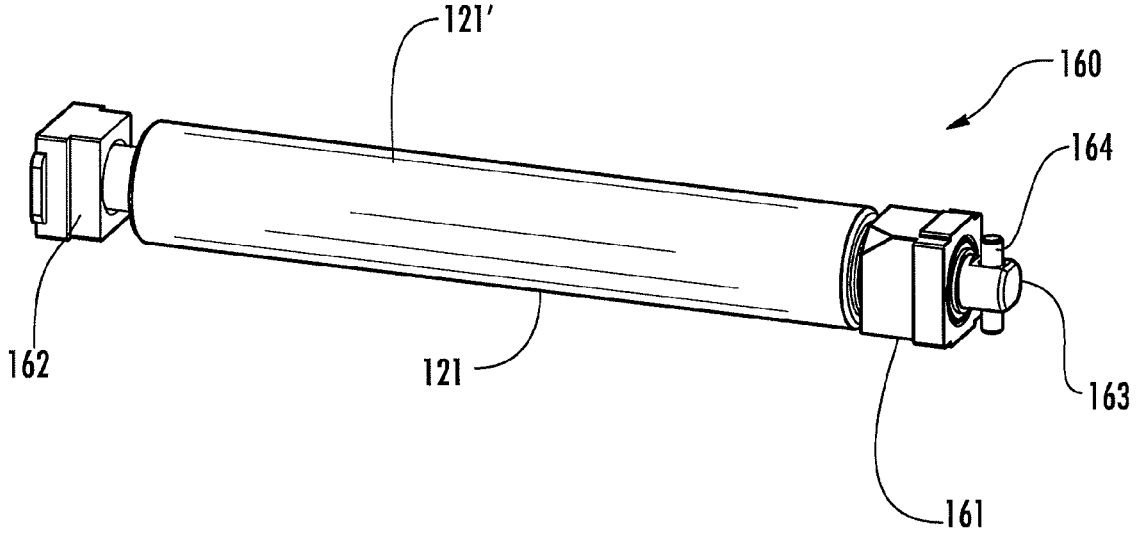
FIG. 6 is a perspective view of a platen roller assembly structured in accordance with one embodiment of the present invention.

FIG. 6 illustrates a platen roller assembly 160 structured in accordance with one embodiment of the present invention. The depicted platen roller assembly 160 comprises a first platen bearing 161, a platen roller 121, a second platen bearing 162, a platen axle 163, and a locking pin 164. The depicted platen roller 121 defines a cylindrical body having a contact surface 121' that is adapted to firmly and uniformly drive media against a printhead. In various embodiments, the contact surface 121' may be made from a rubber or other similar material that is adapted to grip and compress media against a printhead during printing operations. The depicted platen axle 163 extends the full length of the platen roller assembly, through the platen roller 121 and the first and second platen bearings 161, 162, as shown. The depicted first and second platen bearings 161, 162 are structured to allow the platen axle 163 (and platen roller 121) to freely rotate while securely fastened to the first and second support members 138, 139 of the housing frame 180 as discussed in greater detail below.

Figure 7:
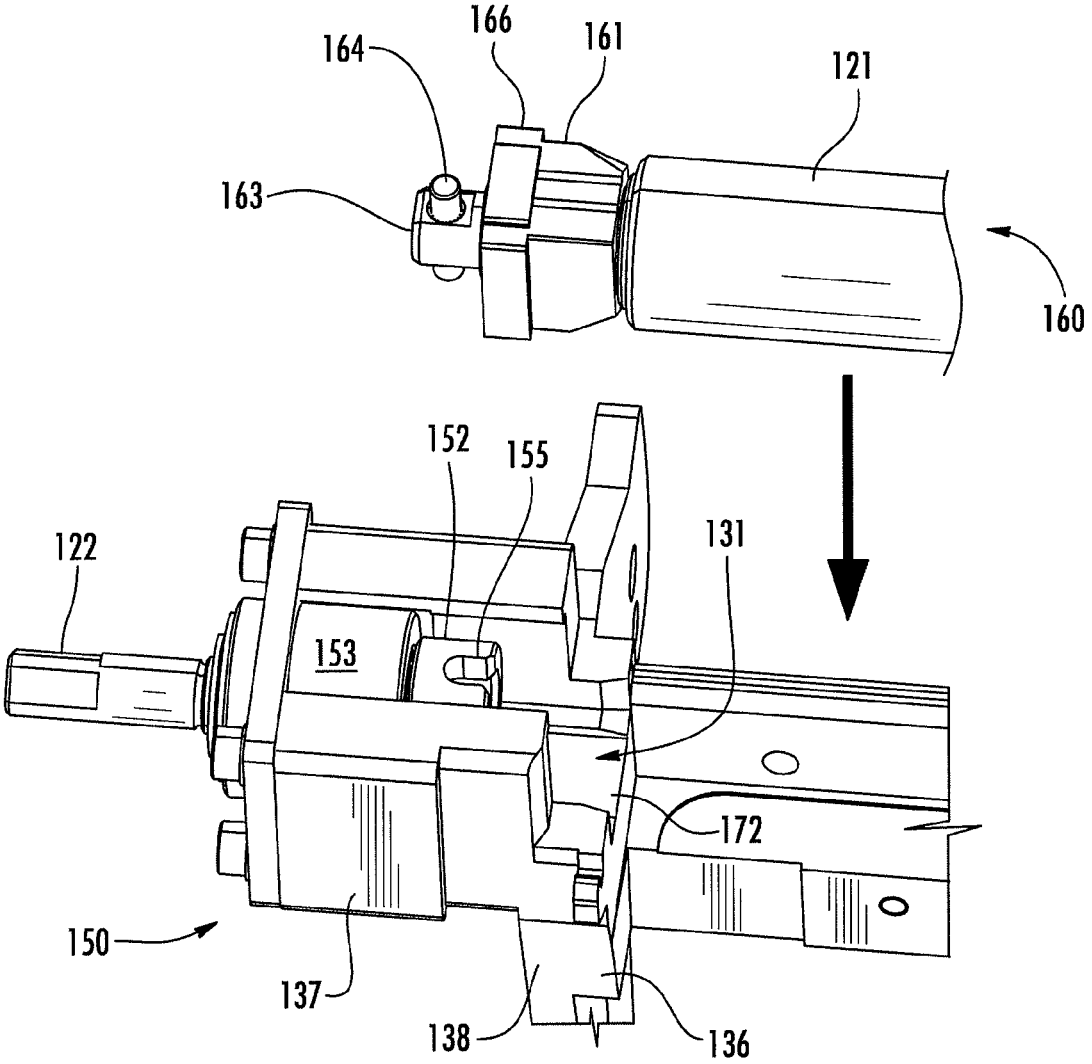
FIG. 7 is a detail view of a platen roller assembly oriented for engagement with a drive assembly supported by a housing assembly in accordance with one embodiment of the present invention.

FIG. 7 is a detail view of a platen roller assembly 160 oriented for engagement with a drive assembly 150, supported by a housing assembly 136 in accordance with one embodiment of the present invention. As noted above, the housing assembly 136 defines a first support member 138 having a drive assembly 150 mounted proximate thereto. The first support member 138 defines a first support notch 131 that is structured to receive the first platen bearing 161 of the platen roller assembly 160. More particularly, in the depicted embodiment, the first support notch 131 defines a generally rectangular first bearing lock pocket 172 that is structured to slidably receive the first platen bearing 161 into a fixed or locked position. The depicted first platen bearing 161 defines a key portion 166 having a generally rectangular outer surface structured to be received in a fixed or locked engagement with the correspondingly rectangular inner surface of the first bearing lock pocket 172. As will be apparent to one of ordinary skill in the art, the inventive concepts defined herein are not limited to platen bearings and lock pockets having rectangular shapes. Instead, these features may define any number of shapes (e.g., triangular, square, notched, round with radial projections, etc.) or key portions so long as they may be secured relative to one another in a fixed or locked position.

As noted above, the drive coupler 152 is adapted to receive and drive the platen axle 163 to rotate during printing operations. In various embodiments of the present invention, the platen axle 163 is configured to extend at least partially beyond the first platen bearing so as to be received within a central cavity defined by the drive coupler 152. The drive coupler 152 further defines a first drive notch 155 and a second drive notch (not shown) about the perimeter of the central cavity for receiving a locking pin 164 disposed through the platen axle 163 as shown. Thus, once the platen axle 163 is seated within the drive coupler central cavity and the locking pin 164 is seated within the first and second drive notches, the drive coupler 152 is adapted to transfer its rotational motion to the platen axle 163 and thereby drive the platen roller 121 during printing operations.

Figure 8:
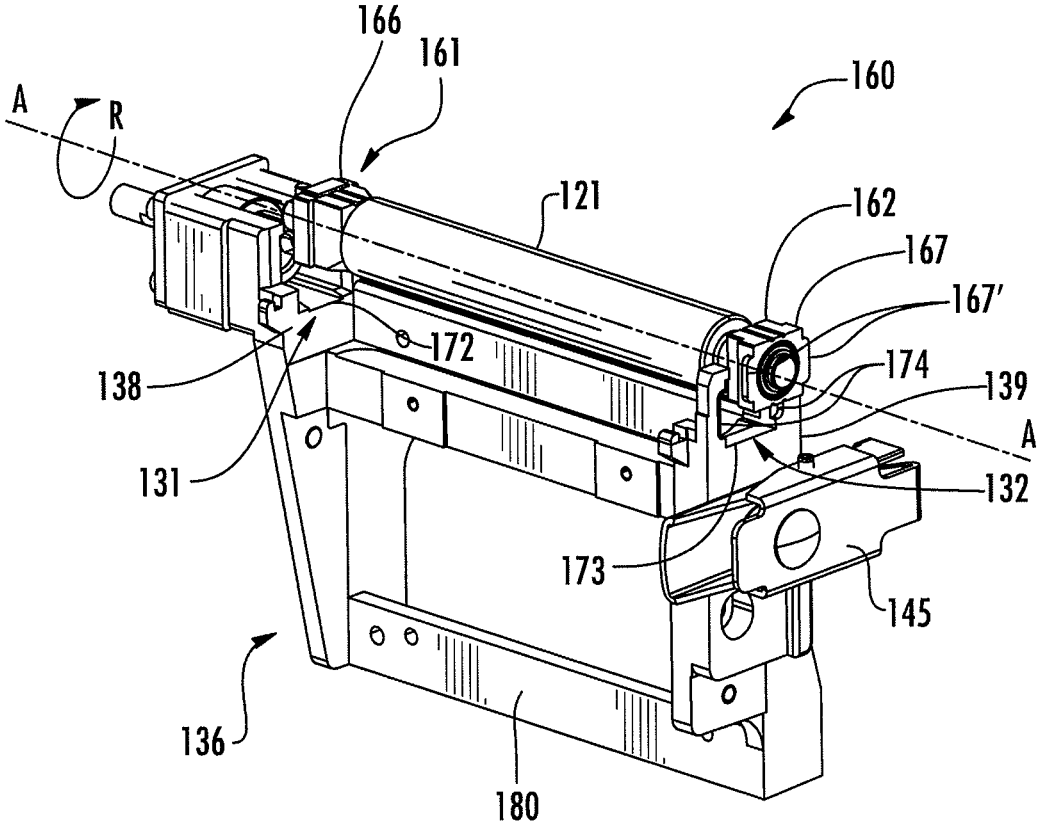
FIG. 8 depicts a platen roller assembly being positioned for installation into a housing assembly in accordance with one embodiment of the present invention.

FIG. 8 depicts a platen roller assembly 160 being positioned for installation into a housing assembly 136 in accordance with one embodiment of the present invention. As noted above, the housing assembly 136 comprises a housing frame 180 having first and second support members 138, 139 each defining respective first and second support notches 131, 132 that are structured to receive the platen roller assembly 160. More specifically, the first and second support notches 131, 132 are adapted to securely receive the first and second platen bearings 161, 162 of the platen roller assembly 160. Noting that the installation of the first platen bearing 161 was discussed generally with regard to FIG. 7 above, the following discussion focuses on the installation of the second platen bearing 162.

The depicted second support notch 132 defines a generally rectangular second bearing lock pocket 173 that is structured to slidably receive the second platen bearing 162 into a fixed or locked position. The depicted second platen bearing 162 defines a generally rectangular key portion 167 having first and second stop flanges 167' extending laterally therefrom. The second platen bearing 162 is structured to be slidably received into a fixed or locked engagement with the correspondingly rectangular inner surface of the second bearing lock pocket 173. Flange recesses 174 are defined at the lateral edges of the second bearing lock pocket 173 for receiving the stop flanges 167' of the second platen bearing 162. As was noted above, the present invention is not limited to rectangular platen bearings and lock pockets as depicted in FIG. 8. Rather, the inventive concepts provided herein may be applied to produce bearing/lock pocket arrangements having any number of shapes (e.g., triangular, square, notched, etc.) so long as they may be secured relative to one another in a fixed or locked position.

Figure 9:
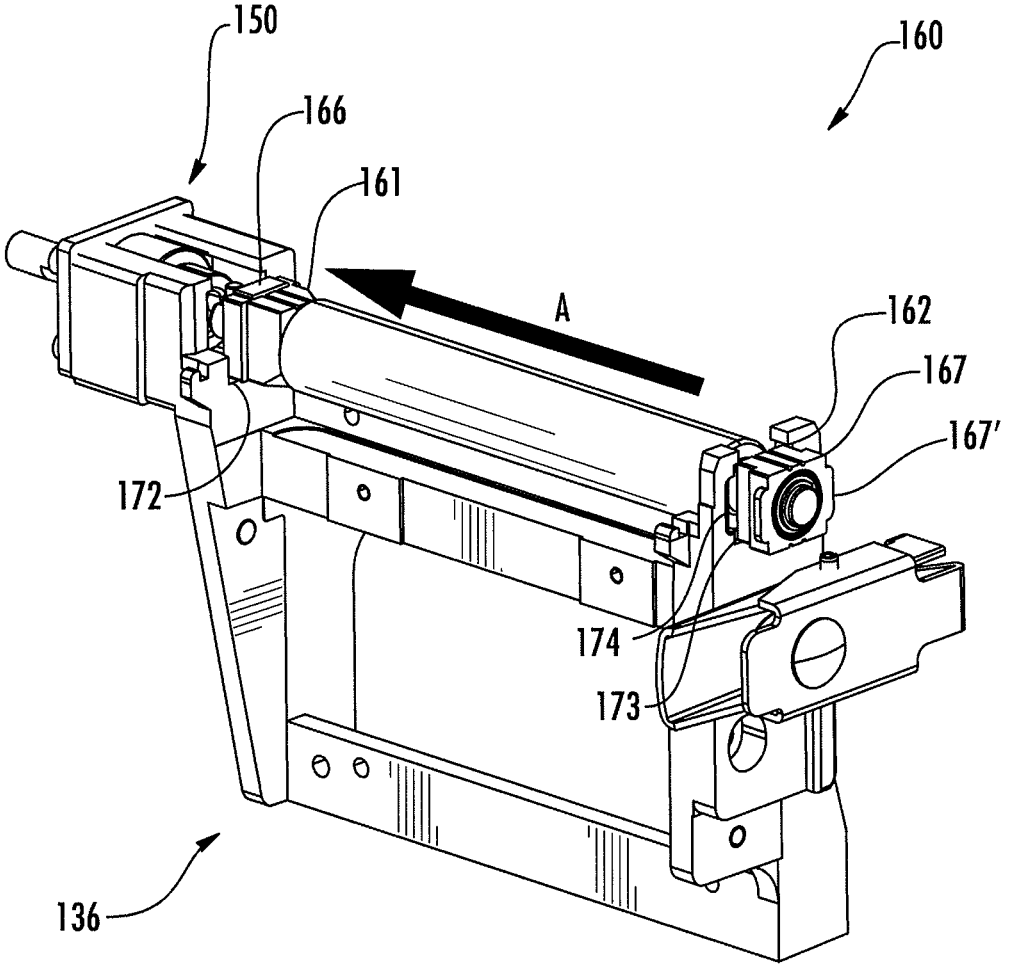
FIG. 9 depicts a platen roller assembly positioned for lateral insertion into the drive assembly and lock pockets of a housing assembly in accordance with one embodiment of the present invention.

FIG. 9 depicts a platen roller assembly 160 positioned for lateral insertion into the drive assembly 150 and lock pockets of a housing assembly 136 structured in accordance with one embodiment of the present invention. The depicted platen roller assembly 160 is disposed in a first installation position wherein the first and second platen bearings 161, 162 are positioned laterally adjacent to their respective first and second lock pockets 172, 173 as shown. In one embodiment, the key portions 166, 167 of the first and second platen bearings 161, 162 are aligned with corresponding surfaces of the respective first and second lock pockets 172, 173 and the platen roller assembly 160 is moved laterally along arrow A to seat the bearings 161, 162 within the lock pockets 172, 173. As will be apparent to one of skill in the art in view of this disclosure, in the depicted embodiment, the ends of the locking pin 164 are aligned with corresponding drive notches 155 of the drive coupler 152 before the platen roller assembly 160 is moved laterally to ensure that the locking pin 164 is properly seated within the drive coupler 152.

Notably, the depicted drive coupler embodiment 152 includes two drive notches 155 corresponding to the two ends of the drive element or locking pin 164. However, in alternate embodiments, differing drive element/drive coupler notch configurations may be used. For example, in one embodiment, the drive element could be a four pronged cross type structure that is configured to extend from one end of the drive axle. Accordingly, the drive coupler would be adapted to have four drive notches corresponding to each of the four drive element prongs. In another embodiment, the drive element could be a series of radially oriented projections extending from the platen axle that are adapted to be received by corresponding radially oriented notches defined by the drive coupler. Other similar configurations will be apparent to one of ordinary skill in the art in view of this disclosure.

Figure 10:
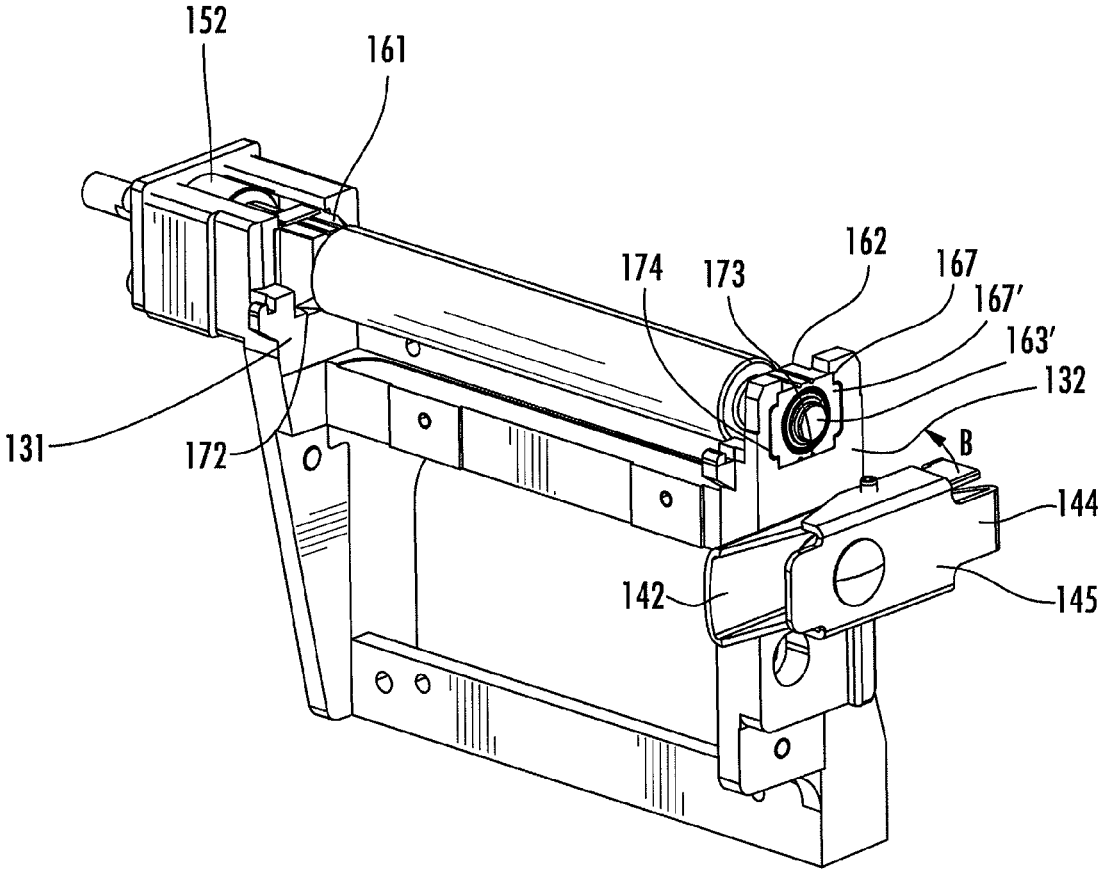
FIG. 10 is a perspective view of a platen roller assembly partially installed into a housing assembly in accordance with one embodiment of the present invention.

FIG. 10 depicts a platen roller assembly 160 partially installed into a housing assembly structured in accordance with one embodiment of the present invention. The depicted platen roller assembly 160 is disposed in a second installation position wherein the first and second platen bearings 161, 162 are seated within corresponding first and second lock pockets 172, 173 defined by the first and second support members 131, 132 of the housing assembly 136. In the depicted embodiment, the stop flanges 167' of the second platen bearing 162 are structured to be received into the flange recesses 174 of the second lock pocket 173 thereby halting the lateral movement of the platen roller assembly 160 as discussed in relation to FIG. 9 such that the platen axle and locking pin ends are seated properly into the drive coupler 152.

Housing assemblies 136 structured in accordance with various embodiments of the present invention may also include a latch assembly 145 as shown. The depicted latch assembly 145 is comprised of a locking plate 142, a spring plate 144, and a pivot pin (not shown) that binds the locking plate 142 and spring plate 144 to the housing frame 180. In various embodiments, the latch assembly 145 may be rotated from the generally horizontal "unlocked" position shown in FIG. 10 to a generally vertical "locked" position along arrow B such that a recess (not shown) defined in the locking plate 142 of the latch assembly 145 slidably captures an extending end 163' of the platen axle. In this way, the locking plate 142 is structured to prevent the platen roller assembly 160 from moving laterally or being removed from the first and second lock pockets 172, 173 when the latch assembly 145 is in the locked position. Although not particularly relevant to various embodiments of the present invention, the depicted spring plate 144 is used to secure the printhead assembly (not shown) in place for printing.

FIGS. 7-10 depict various steps associated with installation of a platen roller assembly into a housing assembly in accordance with various embodiments of the present invention. As will be apparent to one of ordinary skill in the art in view of this disclosure, the depicted platen roller assembly 160 may be removed from the housing assembly 136 by performing the depicted steps in a reverse order. For example, the platen roller assembly 160 may be removed by rotating the latch assembly 145 from a "locked" generally vertical position to an "unlocked" generally horizontal position; sliding the platen roller assembly 160 laterally in a direction opposite to arrow A of FIG. 9 such that the first and second platen bearings 161, 162 become dislodged from the first and second lock pockets 172, 173; ensuring that the locking pin 164 and platen axle 163 are clear of the drive coupler 152; and then simply removing the platen roller assembly 160 from the housing assembly 136.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the amended claims. Although specific terms are employed herein, they are used in a generic and descriptive sense only and not for purposes of limitation.

That which is claimed:

1. A platen assembly, comprising:

a platen roller defining first and second ends and a platen axis extending between the first and second ends;

first and second platen bearing assemblies attached to the platen roller assembly and disposed proximate the first and second ends of the platen roller respectively;

a drive element extending from at least one of the first and second ends of the platen roller;

a housing assembly adapted to rotatably support the platen roller, wherein the first and second platen bearing assemblies are adapted to be slidably received by the housing assembly along a direction substantially parallel to the platen axis, wherein the first and second platen bearing assemblies are both substantially simultaneously slidably received by the housing assembly in response to the platen roller assembly being inserted into the housing assembly in a first direction, and wherein the first and second platen bearing assemblies are prevented from rotating about the platen axis upon being slidably received by the housing assembly.

2. The platen assembly of claim 1, wherein the first and second platen bearing assemblies are adapted to be held substantially rigidly with respect to the housing assembly upon being slidably received by the housing assembly.

3. The platen assembly of claim 1, wherein the housing assembly comprises a first support member defining a first lock pocket and a second support member defining a second lock pocket, and wherein the first and second platen bearing assemblies are adapted to be slidably received by the first and second lock pockets respectively.

4. The platen assembly of claim 3, wherein the first platen bearing assembly defines a first key portion, the second platen bearing assembly defines a second key portion, and wherein the first and second key portions are structured to be received by the first and second lock pockets.

5. The platen assembly of claim 1, wherein the platen roller comprises a platen axle and the drive element defines a locking pin comprising two prongs that extend from the platen axle, and wherein the drive assembly comprises a drive coupler defining a central cavity and two drive notches for receiving the platen axle and the two prongs of the locking pin, respectively.

6. The platen assembly of claim 1, wherein the platen roller comprises a platen axle, wherein the drive element defines a locking pin comprising four prongs that extend from the platen axle, and wherein the drive assembly comprises a drive coupler defining a central cavity and four drive notches for receiving the platen axle and the four prongs of the locking pin, respectively.

7. The platen assembly of claim 1, further comprising a latch assembly for securing the platen roller to the housing assembly such that a drive coupler of the drive assembly is locked in rotatable engagement with the drive element.

8. The platen assembly of claim 1, further comprising a latch assembly, wherein the latch assembly is configured to preclude movement of the platen roller in a direction substantially opposite the first direction.

9. A platen assembly, comprising;

a platen roller defining first and second ends and a platen axis extending between the first and second ends;

first and second platen bearing assemblies attached to the platen roller assembly and disposed proximate the first end and second end of the platen roller respectively;

a drive element extending from at least one of the first and second ends of the platen roller;

a housing assembly adapted to rotatably support the platen roller, wherein the first and second platen bearing assemblies are adapted to be slidably received by the housing assembly, wherein the first and second platen bearing assemblies are both slidably received by the housing assembly substantially simultaneously in response to the platen roller assembly being inserted into the housing assembly in a first direction, and wherein the first and second platen bearing assemblies are prevented from rotating about the platen axis upon being slidably received by the housing assembly; and a drive assembly disposed operably adjacent to the platen roller, wherein the drive assembly comprises a drive coupler that is adapted to rotatably engage the drive element extending from the at least one of the first and second ends of the platen roller.

10. The platen assembly of claim 9, wherein the first and second platen bearing assemblies are adapted to be held substantially rigidly with respect to the housing assembly upon being slidably received by the housing assembly.

11. The platen assembly of claim 9, wherein the housing assembly comprises a first support member defining a first lock pocket and a second support member defining a second lock pocket, and wherein the first and second platen bearing assemblies are adapted to be slidably received by the first and second lock pockets respectively.

12. The platen assembly of claim 11, wherein the first platen bearing assembly defines a first key portion, the second platen bearing assembly defines a second key portion, and wherein the first and second key portions are structured to be received by the first and second lock pockets.

13. The platen assembly of claim 9, wherein the platen roller comprises a platen axle and the drive element defines a locking pin comprising two prongs that extend from the platen axle, and wherein the drive coupler defines a central cavity and two drive notches for receiving the platen axle and the two prongs of the locking pin, respectively.

14. The platen assembly of claim 9, further comprising a latch assembly for securing the platen roller to the housing assembly such that the drive coupler of the drive assembly is locked in rotatable engagement with the drive element.

15. The platen assembly of claim 9, further comprising a latch assembly, wherein the latch assembly is configured to preclude movement of the platen roller in a direction substantially opposite the first direction.

16. A printing system comprising:

a printhead;

a platen assembly disposed opposite the printhead adapted to grip and drive a media unit into the printhead during printing operations, the platen assembly comprising:

a platen roller defining first and second ends and a platen axis extending between the first and second ends, first and second platen bearing assemblies attached to the platen roller assembly and disposed proximate the first end and second end of the platen roller respectively, a drive element extending from at least one of the first and second ends of the platen roller;

a housing assembly adapted to rotatably support the platen roller, wherein the first and second platen bearing assemblies are adapted to be slidably received by the housing assembly, wherein the first and second platen bearing assemblies are both slidably received by the housing assembly substantially simultaneously in response to the platen roller assembly being inserted into the housing assembly in a first direction, and wherein the first and second platen bearing assemblies are prevented from rotating about the platen axis upon being slidably received by the housing assembly; and a drive assembly disposed operably adjacent to the platen roller, wherein the drive assembly comprises a drive coupler that is adapted to rotatably engage the drive element extending from the at least one of the first and second ends of the platen roller.

17. The printing system of claim 16, wherein the first and second platen bearing assemblies are adapted to be held substantially rigidly with respect to the housing assembly upon being slidably received by the housing assembly.

18. The printing system of claim 16, wherein the housing assembly comprises first and second support members that are structured to slidably receive the first and second bearing assemblies.

19. The printing system of claim 16, further comprising a latch assembly for securing the platen roller to the housing assembly such that the drive coupler of the drive assembly is locked in rotatable engagement with the drive element.

20. The printing system of claim 16, wherein the housing assembly comprises a first support member defining a first lock pocket and a second support member defining a second lock pocket, and wherein the first and second platen bearing assemblies are adapted to be slidably received by the first and second lock pockets respectively.

21. The platen assembly of claim 20, wherein the platen roller comprises a platen axle and the drive element defines a locking pin comprising two prongs that extend from the platen axle, and wherein the drive coupler defines a central cavity and two drive notches for receiving the platen axle and the two prongs of the locking pin, respectively.

* * * * *